US005228393A

United States Patent [19]

Woolston

[11] Patent Number: 5,228,393

[45] Date of Patent: Jul. 20, 1993

[54] CENTER PLATE FRICTION REDUCING ASSEMBLY

[75] Inventor: Robert D. Woolston, Portland, Oreg.

[73] Assignee: Gunderson, Inc., Portland, Oreg.

[21] Appl. No.: 911,869

[22] Filed: Jul. 10, 1992

[51] Int. Cl.[5] ..... B32B 31/04

[52] U.S. Cl. ..... 105/199.4

[58] Field of Search ..... 105/199.1, 199.4; 384/422

[56] References Cited

U.S. PATENT DOCUMENTS

| | | | |
|---|---|---|---|
| 2,558,069 | 6/1951 | Alben | 105/199.4 |
| 2,600,704 | 6/1952 | Travilla et al. | 105/199.4 |
| 3,711,927 | 1/1973 | Davidson | 105/199.4 |
| 4,307,669 | 12/1981 | Koester et al. | 105/199.4 |
| 4,548,666 | 12/1985 | Mathieu | 105/199.4 |

FOREIGN PATENT DOCUMENTS

| | | | |
|---|---|---|---|
| 0522616 | 11/1955 | Belgium | 105/199.4 |
| 1675082 | 12/1970 | Fed. Rep. of Germany | 105/199.4 |

*Primary Examiner*—Mark T. Le

*Attorney, Agent, or Firm*—Chernoff, Vilhauer, McClung & Stenzel

[57] ABSTRACT

A low friction, high wear rail car center plate assembly of the type where a cylindrical center plate boss having a planar bottom surface and a perpendicular side wall rides rotationally in a mating bowl in a truck bolster, includes a boot which closely overlies the center plate boss, and axial and radial wear structures which fit within the bowl, so that the boot abuts the wear structures. The wear structures are preferentially formed of a composite bearing material, having an inner acetal resin surface, and the boot has a hard, highly polished surface. The boot includes an elastomeric or metallic seal ring cover that extends over the bowl and prevents foreign matter from getting between the bowl and the wear structures.

1 Claim, 5 Drawing Sheets

CENTER PLATE FRICTION REDUCING ASSEMBLY

BACKGROUND OF THE INVENTION

This invention relates to a rail car center plate, and more particularly to a low friction, high wear center plate assembly.

A railroad car is typically mounted on a truck using a center plate assembly consisting of a cylindrical cast center plate, having a vertical side wall and a planar bottom, which rides in a cast bowl-shaped depression in the truck. To prevent one cast part from wearing on the second cast part, a steel wear plate is interposed between the center plate and the bowl. The wear plate is lubricated to further reduce friction. For a rail car traveling the average 100,000 miles a year, the wear plate must be relubricated every 2–3 months.

An alternative to the steel wear plate for reducing friction is a plastic cap which is placed over the center plate. However, both sides of the plastic cap are exposed to cast metal and thus the plastic wears quickly.

Railroads increasingly employ multiple unit articulated cars in which the ends of adjacent cars are carried on a common truck bolster located between the two units. With articulated cars consideration must also be given to the truck turning moment, since center plate binding caused by side loads is a suspected cause of derailment in articulated cars. European-type spherical bearings cannot be used to reduce the effect of side loads because of the increased rocking stability requirements necessitated by the height and weight of American double-stack freight cars.

What is still needed is a center plate bearing assembly that will reduce center plate bearing friction, reduce bearing wear, and reduce bearing maintenance.

SUMMARY OF THE INVENTION

For a center plate assembly of the type where a cylindrical center plate boss having a planar bottom and a vertical side wall rides rotationally in a mating bowl in a truck bolster, the present invention provides a low friction, high wear rail car center plate assembly consisting of axial and radial wear structures that fit within the bowl together with a boot which overlies the center plate boss. The boot is interposed between the center plate boss and the wear structures and may include a seal ring, formed of a material such as metal or an elastomer, for preventing foreign matter from getting between the boot and the wear structures. The wear structures consist of an outer rigid metal backing layer, a middle porous bronze layer and an inner acetal resin layer. The axial wear structure is formed of a series of side-by-side trapezoidal elements and is fastened, by glue or rivets, to a rigid metal support plate. The radial wear structure is adjacent the side wall of the bowl.

It is a principal object of the invention to provide a center plate assembly that reduces center plate friction and wear.

It is a related object of the invention to provide a center plate assembly with a reduced required truck turning moment, thereby reducing center plate binding.

It is a further object of the present invention to provide a center plate assembly having reduced maintenance requirements.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
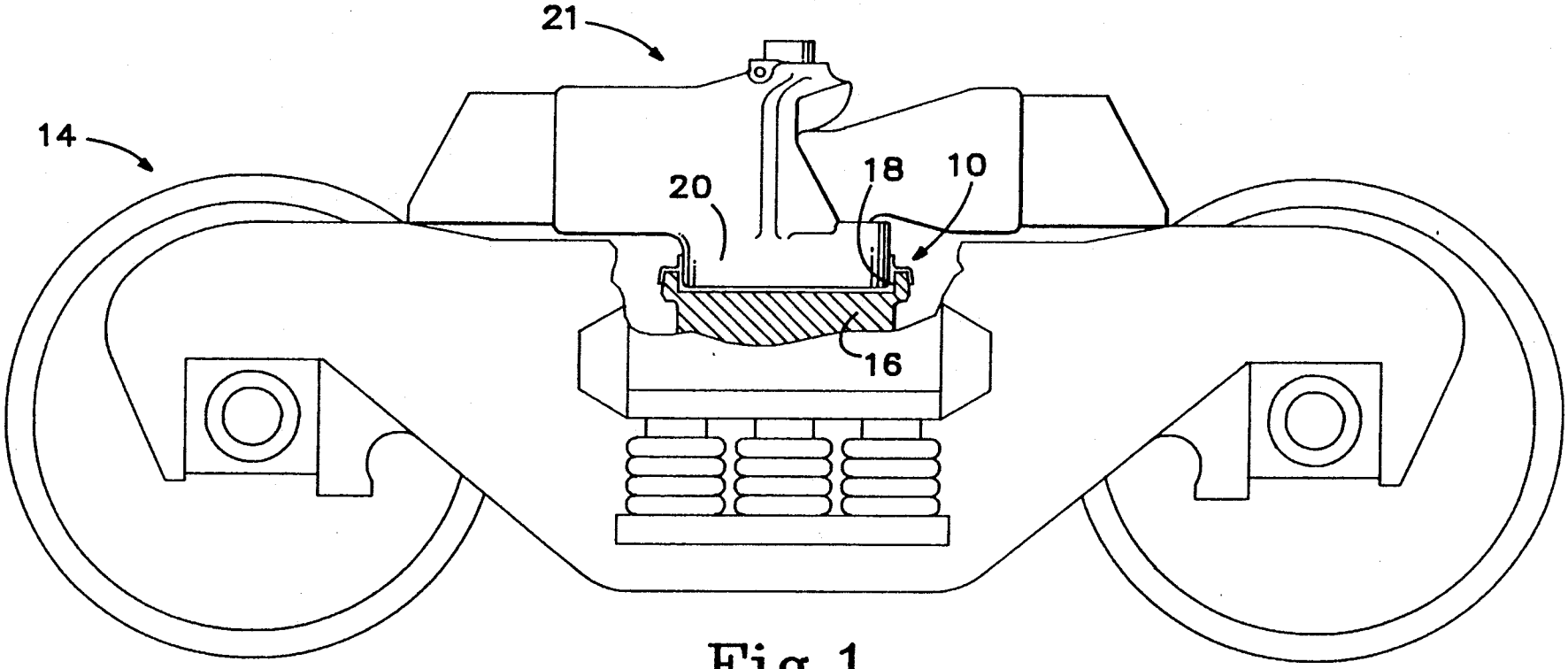
FIG. 1 is a side elevational view of a rail truck bolster and articulated rail car connector with a portion of the truck broken away showing a center plate assembly embodying the present invention.

A rail car center plate assembly 10 for an articulated rail car, which is a preferred embodiment of the present invention, is shown in FIGS. 1–7. As shown in FIG. 1, a rail car truck 14 includes a truck bolster 16 having a bowl 18 that matingly receives the generally cylindrical center plate boss 20 of the articulated connection assembly 21.

Figure 2:
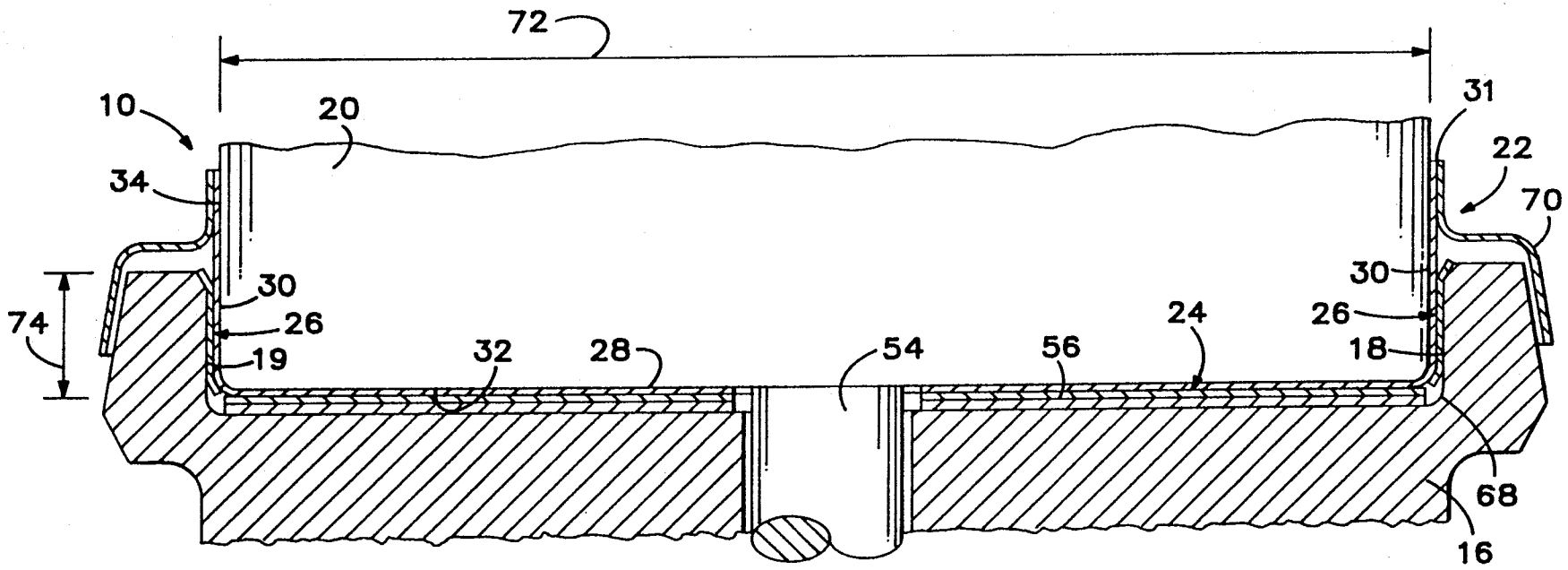
FIG. 2 is a sectional side elevational view of a portion of the center plate assembly of FIG. 1, shown at an enlarged scale.

As best shown in FIG. 2, the rail car center plate assembly of the present invention includes a boot 22 that overlies and preferably is firmly attached, with, for example, glue, to the center plate boss 20. The boot 22 has a generally planar bottom 28 and a generally perpendicular cylindrical side wall 30 that corresponds to the generally planar bottom 32 and perpendicular side wall 34 of the cylindrical center plate boss 20. The boot is preferably made of a metallic material, such as a stainless steel, which has a highly polished, smooth surface finish, preferably at least a 32 microinch finish, and possibly a surface finish of up to 16 microinches.

Figure 5:
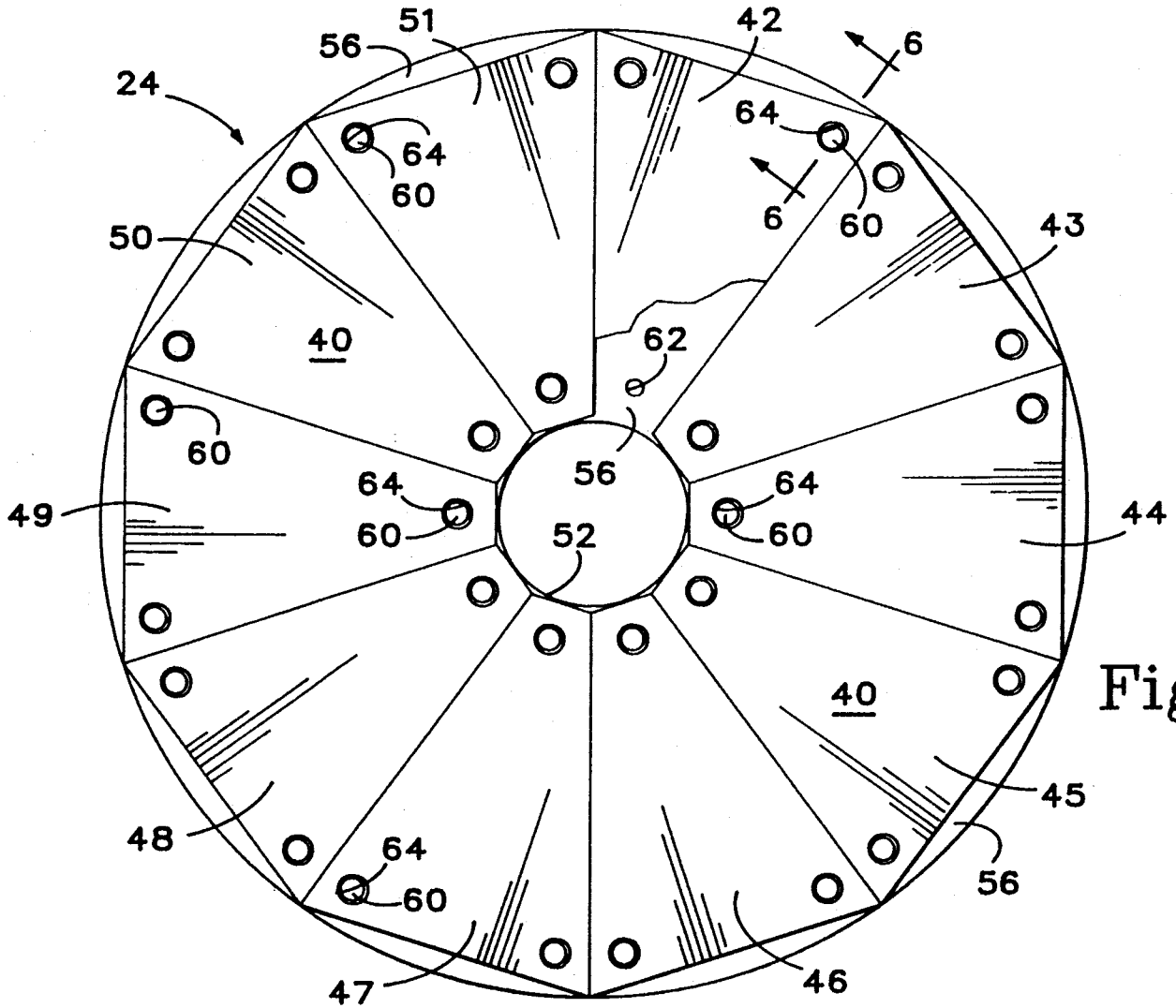
FIG. 5 is a plan view of the axial wear structure of the present invention with a portion of the structures broken away.
Figure 7:
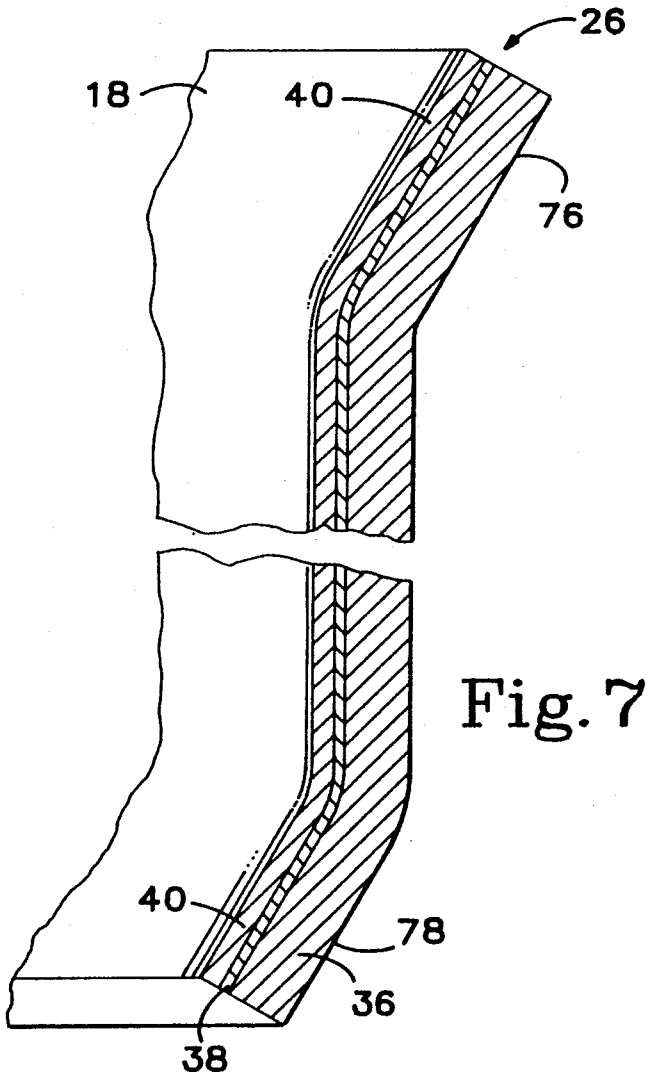
FIG. 7 is a shortened sectional view of the horizontal wear structure of the present invention, shown at an enlarged scale.
Figure 6:
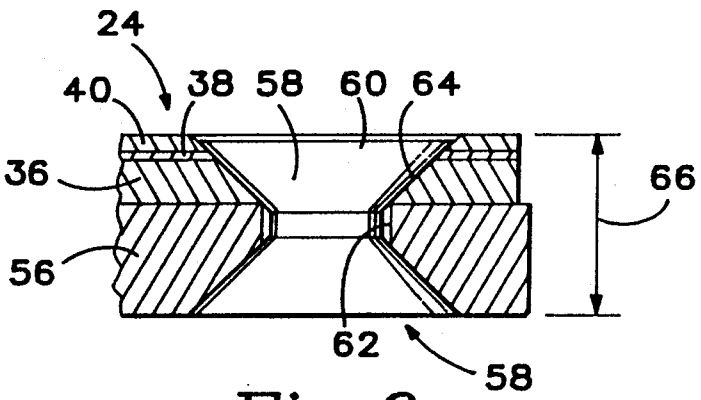
FIG. 6 is a sectional view taken along line 6—6 on FIG. 5, shown at an enlarged scale.

Referring now to FIGS. 5–7, an axial wear structure 24 and a radial wear structure 26 formed of a bearing material fit within the bowl 18 of the truck bolster 16. In a preferred embodiment of the present invention, the bearing material is a composite bearing material such as that manufactured by Garlock Bearings, Inc. of Thorofare, N.J., under the trade name Garlock DX. As best shown in FIG. 7, the composite bearing material has a first or outer layer 36 of a rigid metal backing material such as steel, a second or middle layer 38 of a porous bronze metal, and a third or inner layer 40 of an acetal resin.

Alternatively, the bearing material could be Garlock DU, in which the inner layer 40 is polytetrafluoroethylene rather than acetal resin. While the DU material has a lower coefficient of friction than the DX material it has less capability to hold up under the heavy loads encountered in this application.

Figure 4:
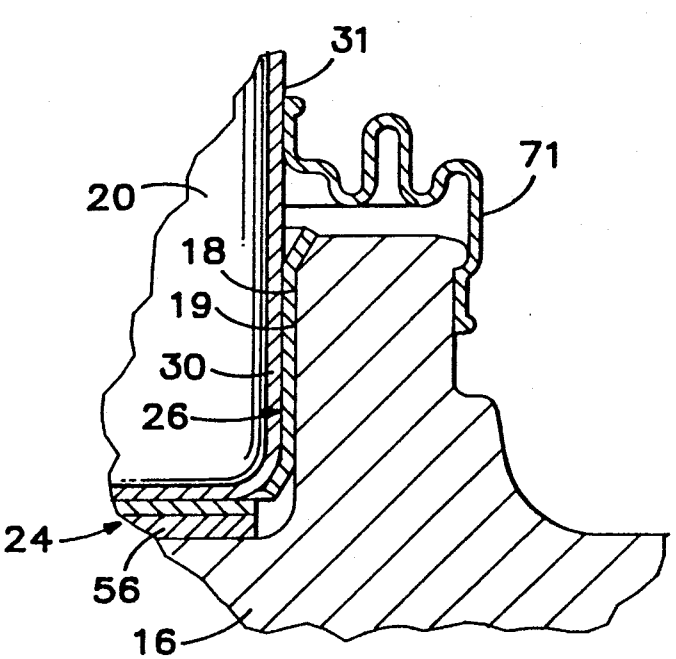
FIG. 4 is a fragmentary view, similar to FIG. 3, of an alternative embodiment of the center plate assembly.
Figure 3:
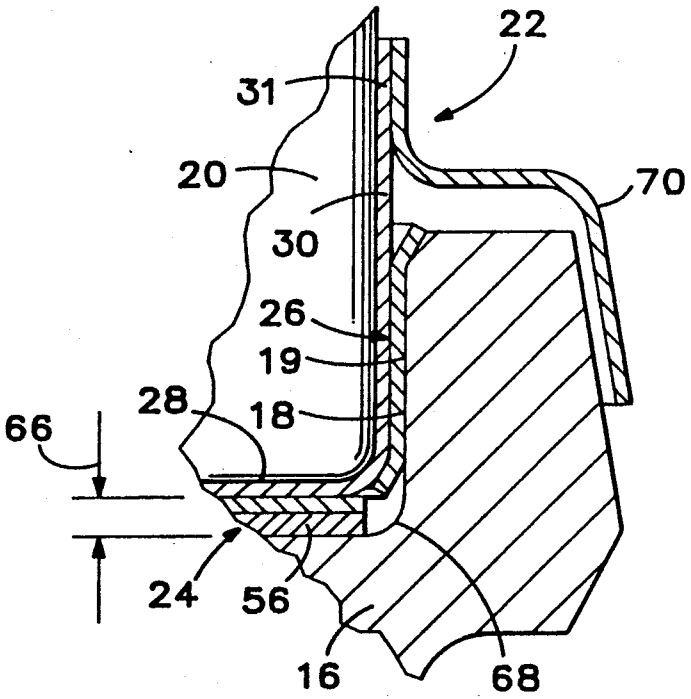
FIG. 3 is a fragmentary view of the center plate assembly of FIG. 2 shown at an enlarged scale.

As best shown in FIG. 5, the axial wear structure 24 is composed of elements of the bearing material arranged as a series of trapezoidal elements 42–51. In a preferred embodiment of the present invention, the trapezoidal elements 42–51 of the axial wear structure are attached to a support plate 56 made of a rigid metal such as steel around an opening 52 which receives the center pin 54 of the center plate. The trapezoidal-shaped elements of the axial wear structure may be adhesively bonded to the support plate by any suitable adhesive. In addition, the trapezoidal elements are attached to the support plate by rivets 58 or the like. Referring to FIG. 6, a hole 64 in the axial wear structure is aligned with a hole 62 in the backing plate and is sized so that, once the rivet is inserted, the head 60 of the rivet lies below the surface of the acetal resin outer layer 40 of the bearing material. As shown in FIGS. 2–4, the combined height 66 of the support plate 56 and the wear structure 24 should be at least equal to the radius of curvature 68 of the bowl 18.

The radial wear structure 26, composed of the same bearing material as the axial wear structure, has a diameter 72 and a height 74 to generally conform to the side wall 19 of the truck bowl, as shown in FIGS. 2–4. In a preferred embodiment of the present invention, as best shown in FIG. 7, a single sheet of bearing material is shaped with upper 76 and lower 78 chamfers to more closely conform to the truck bowl.

In a preferred embodiment of the present invention, the boot includes a seal ring 70 or 71 which is attached to the boot adjacent the upper end 31 of its side wall 30, and extends over and covers the bowl 18 of the truck when the center plate boss 20 is placed in the bowl 18. The seal ring prevents dirt and other foreign matter from getting between the boot and the wear structures thus significantly extending, by up to two years, the time before maintenance of the articulated rail connection is required. As shown in FIGS. 2–4, the seal ring, which may be formed of any durable, chemically resistant material that adheres to or can be fastened adjacent the upper end of the boot, is preferably a metallic material such as steel which is spot-welded to the boot (FIGS. 2, 3), or an elastomeric material such as neoprene (FIG. 4).

When the rail car connection is assembled and the center boss engages the truck bowl, the highly polished planar bottom surface of the boot contacts the planar wear surface of the acetal resin inner layer of the axial wear structure and the perpendicular side wall of the boot contacts the cylindrical wear surface of the acetal resin inner layer of the horizontal wear structure to provide a center plate assembly connection having a reliable, consistent low coefficient of friction and thus a reduced required truck turning moment and a long life. The seal ring excludes foreign material from the center plate assembly further extending the time before maintenance is required.

One difficulty with the Garlock DX bearing material is that it is not electrically conductive so that static electricity generated in the rail cars cannot be conducted through the center bearing to the rails. This probably will not be a problem since the outside trucks on each end car unit do not have an articulated connection and will not require the use of the subject low friction assembly. If necessary, however, the subject bearing assembly could be made electrically conductive, for example, by placing brass inserts in the acetal resin layer.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A low friction, high wear rail car center plate assembly including a cylindrical center plate boss having a planar bottom surface and a perpendicular side wall which rides rotationally in a mating bowl in a truck bolster, said assembly comprising:

(a) a boot which overlies the center plate boss, having a planar bottom surface and a perpendicular side wall;

(b) an axial wear structure which fits within the bowl, having a planar wear surface which abuts said bottom surface of said boot;

(c) a radial wear structure which fits within the bowl, having a cylindrical wear surface which abuts said perpendicular side wall of said boot, said wear structures including:

(i) a rigid metal backing layer;

(ii) an acetal resin layer;

(iii) a porous bronze layer located between said backing layer and said resin layer; and (iv) a rigid metal support plate to which said backing layer is attached; and (d) wherein said backing layer, said acetal resin layer and said porous bronze layer comprise a series of side-by-side trapezoidal elements.

* * * * *